US007978153B2

(12) United States Patent
Hagihara et al.

(10) Patent No.: US 7,978,153 B2
(45) Date of Patent: Jul. 12, 2011

(54) PLASMA DISPLAY DEVICE

(75) Inventors: Sojiro Hagihara, Yokohama (JP); Akihiro Machida, Kyonan (JP); Hidenori Ohnuki, Kawasaki (JP); Hideaki Ohki, Tokyo (JP)

(73) Assignee: Fujitsu Hitachi Plasma Display Limited, Miyazaki-ken (JP)

( * ) Notice: Subject to any disclaimer, the term of this patent is extended or adjusted under 35 U.S.C. 154(b) by 1468 days.

(21) Appl. No.: 11/418,141

(22) Filed: May 5, 2006

(65) Prior Publication Data

US 2006/0256043 A1 Nov. 16, 2006

(30) Foreign Application Priority Data

May 13, 2005 (JP) ..... 2005-141134

(51) Int. Cl.
*G09G 3/28* (2006.01)

(52) U.S. Cl. ..... 345/60; 345/61; 345/62; 345/63

(58) Field of Classification Search ..... 345/60–72
See application file for complete search history.

(56) References Cited

U.S. PATENT DOCUMENTS

| | | | | |
|---|---|---|---|---|
| 6,738,032 | B1 * | 5/2004 | Park | 345/60 |
| 6,885,158 | B2 | 4/2005 | Onozawa | |
| 7,397,186 | B2 * | 7/2008 | Kwon et al. | 313/583 |

FOREIGN PATENT DOCUMENTS

| | | |
|---|---|---|
| CN | 1505084 | 6/2004 |
| JP | 2000-284747 | 10/2000 |
| JP | 2001-185040 | 7/2001 |
| JP | 2003-338249 | 11/2003 |
| JP | 2004-184682 | 7/2004 |
| KR | 2001-51768 | 6/2001 |
| KR | 10-2004-0088939 | 10/2004 |

* cited by examiner

*Primary Examiner* — Richard Hjerpe
*Assistant Examiner* — Leonid Shapiro
(74) *Attorney, Agent, or Firm* — Antonelli, Terry, Stout & Kraus, LLP.

(57) ABSTRACT

The plasma display device includes connecting means for connecting the X/Y electrodes of the plasma display panel and the X/Y electrode drive circuits. In the X electrode pattern and the Y electrode pattern on the printed board in the connecting means, a current path connecting the center electrodes of the plasma display panel and the X electrode drive circuit or Y electrode drive circuit is longer than a current path connecting the peripheral electrodes and the X electrode drive circuit or Y electrode drive circuit. The current paths at the plasma display panel side are in the U-shape folded in the upper part and the lower part in the periphery of the plasma display panel, respectively. Also, the current paths are first connected to the upper or lower electrodes, and then sequentially connected to the center electrodes via the upper part and the lower part.

20 Claims, 17 Drawing Sheets

*FIG. 18A* *FIG. 18B*
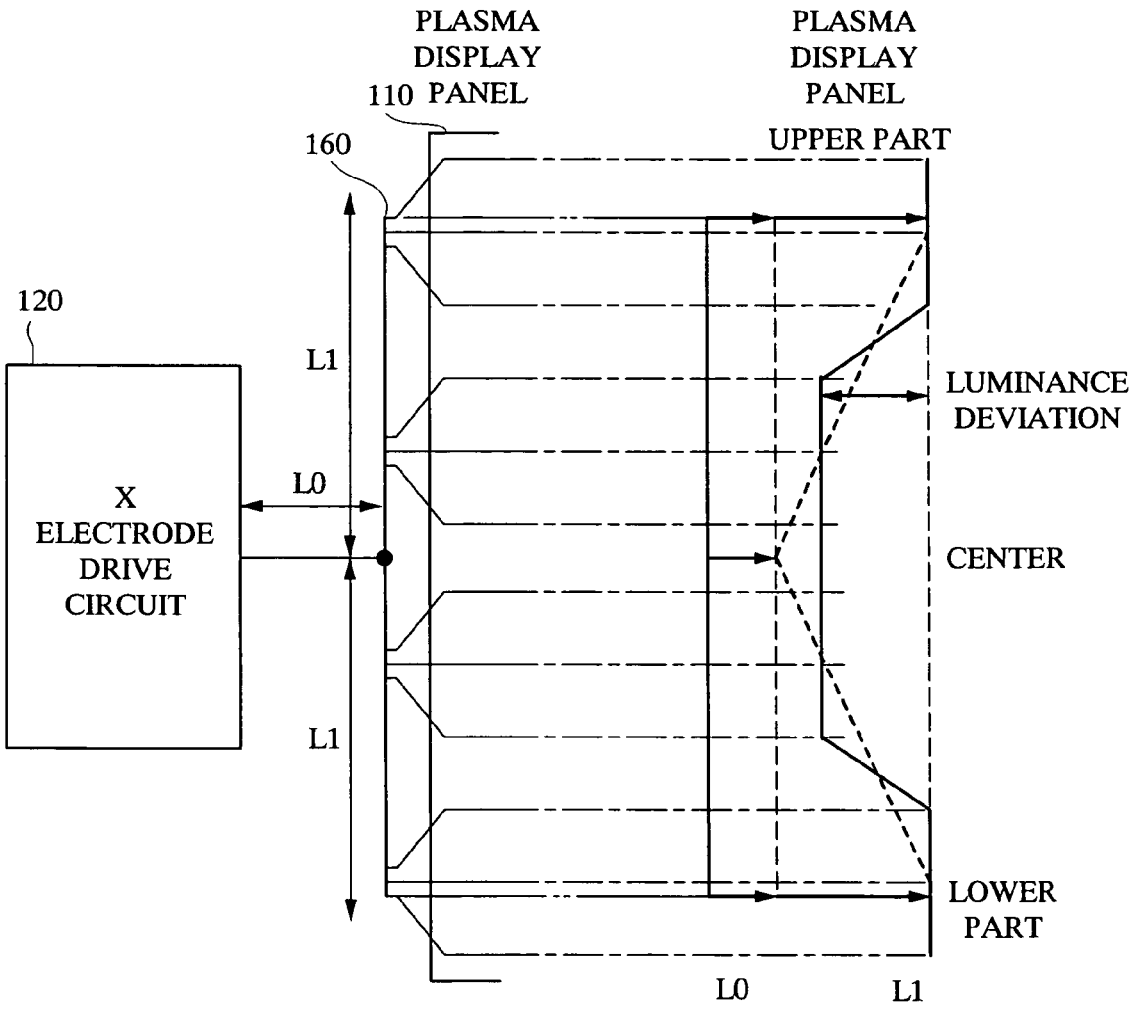

PLASMA DISPLAY DEVICE

CROSS-REFERENCE TO RELATED APPLICATION

The present application claims priority from Japanese Patent Application No. JP 2005-141134 filed on May 13, 2005, the content of which is hereby incorporated by reference into this application.

TECHNICAL FIELD OF THE INVENTION

The present invention relates to a technology for a plasma display device. More particularly, it relates to a technology effectively applied to a connection structure between X/Y electrodes and X/Y electrode drive circuits in a plasma display panel.

BACKGROUND OF THE INVENTION

For example, a conventional plasma display device is comprised of, as shown in FIG. 12, a plasma display panel 110, an X electrode drive circuit 120 for driving a plurality of X electrodes of the plasma display panel 110, a Y electrode drive circuit 130 for driving a plurality of Y electrodes thereof, an address electrode drive circuit 140 for driving a plurality of address electrodes thereof, a scan circuit 150 for scanning a plurality of Y electrodes thereof, and others. In such a structure, each X electrode and the X electrode drive circuit 120, and each Y electrode and the Y electrode drive circuit 130 in the plasma display panel 110 are electrically connected through connecting means 160 and 170 such as a printed board and flexible substrate, respectively.

More specifically, the connection between each X electrode of the plasma display panel 110 and the X electrode drive circuit 120 will be described as an example with reference to FIG. 13. Each X electrode of the plasma display panel 110 is connected to the X electrode drive circuit 120 through a printed board 161 and a flexible substrate 162. The X electrode drive circuit 120 and the printed board 161, and the printed board 161 and the flexible substrate 162 are connected via connectors 163 and 164, respectively, and a conductor of the flexible substrate 162 is connected to each X electrode of the plasma display panel 110 by thermocompression or the like. Further, an X electrode pattern 165 for connecting the connector 163 and the connectors 164 is formed on the printed board 161.

As a technology which focuses attention on a luminance difference between regions in a screen in such a plasma display device, a technology described in Japanese Patent Application Laid-Open Publication No. 2000-284747 (Patent Document 1) is known.

SUMMARY OF THE INVENTION

In the plasma display device described above, the X electrode drive circuit and the Y electrode drive circuit are electrically connected to the plasma display panel through a printed board and a flexible substrate. However, due to the difference in wiring length of the physical current paths, an inductance deviation occurs, and a phenomenon occurs in which a luminance difference becomes apparent in uniform display on the entire screen. In particular, it is a notable trend in the enlargement of the screen size of the plasma display panel.

For example, in the connection between the X electrode drive circuit 120 and the plasma display panel 110 (from the center to the upper part) shown in FIG. 14 in the above-described connection form of FIG. 13, an inductance in the current path between the X electrode drive circuit (a) and the center electrode (b) of the plasma display panel is L0, and an inductance in the current path between the center electrode (b) and the upper electrode (c) is L1.

An equivalent circuit in this case can be expressed by a circuit structure shown in FIG. 15 in which power supplies (Vs, Vs/2), a power reduction coil, switches (SW1 to SW3), parasitic inductances (L0, L1) and others are connected. Point (a) corresponds to a connection point between the switches SW1, SW2, and SW3 and L0, point (b) corresponds to a connection point between L0 and L1, and point (c) corresponds to an open point of L1. Drive waveforms at each of the points (a), (b), (c) are as shown in FIG. 16, in which overshoot and undershoot relative to a drive waveform (Vs) at point (a) occur at point (b) and overshoot and undershoot voltages over those at the point (b) occur at point (c).

Such a parasitic inductance distribution can be also considered as a phenomenon of luminance distribution. In considering this phenomenon for the entire plasma display panel 110, as shown in a parasitic inductance distribution of FIG. 17A and a luminance distribution of FIG. 17B, the center of the plasma display panel 110 has the luminance corresponding to L0, and the upper and lower parts of the plasma display panel 110 have the luminance corresponding to L0+L1. Therefore, a luminance difference corresponding to a deviation by L1 occurs between the center part and the upper and lower parts. Hence, it has been desired to suppress this luminance difference below a permissible value in the trend of enlargement of the screen size of the plasma display panel 110.

In particular, in the case where the flexible substrate is separated into those for the X electrodes and the Y electrodes along with the enlargement in the screen size of the plasma display panel, further techniques are required. In promoting the separation of the flexible substrate, the luminance difference is apt to occur due to the inductance deviation caused by the discretization of common impedance. For example, a luminance distribution in the case of the discrete connection of the flexible substrates corresponds to a parasitic inductance distribution of FIG. 18A and a luminance distribution of FIG. 18B (a dashed line in the luminance distribution is that of FIG. 17B).

The parasitic inductance increases more in the upper and lower parts of the plasma display panel. Thus, a resonance voltage generated by the parasitic inductance and the panel capacitance becomes larger in the upper and lower parts. Consequently, there arises a problem that a luminance ratio is higher in the upper and lower parts than that in the center of the plasma display panel.

The technology in Patent Document 1 focuses attention on the luminance difference between regions in the screen. However, it does not describe a connection structure between the X/Y electrodes and the X/Y electrode drive circuits in the plasma display panel.

Therefore, an object of the present invention is to provide a plasma display device capable of increasing the luminance in the center part of a screen, by suppressing an inductance deviation to reduce a luminance difference in the entire screen below a permissible value in order to solve the problems described above.

The above and other objects and novel characteristics of the present invention will be apparent from the description of this specification and the accompanying drawings.

The typical ones of the inventions disclosed in this application will be briefly described as follows.

The plasma display device according to the present invention comprises: connecting means for connecting each X electrode of a plasma display panel and an X electrode drive circuit and connecting each Y electrode of the plasma display panel and a Y electrode drive circuit, respectively, and the plasma display device has features as follows.

(1) In the connecting means, a current path connecting center electrodes of the plasma display panel and the X electrode drive circuit or Y electrode drive circuit is longer than a current path connecting peripheral electrodes of the plasma display panel and the X electrode drive circuit or Y electrode drive circuit.

(2) The current paths at the plasma display panel side of the connecting means are in a U-shape folded in the upper part and the lower part in the periphery of the plasma display panel, respectively. The current paths are first connected to the upper electrodes and lower electrodes of the plasma display panel, respectively, extend through an upper part and a lower part, and then sequentially connected to the center electrodes of the plasma display panel.

(3) A first current path extending through the upper part of the plasma display panel and a second current path extending through the lower part of the plasma display panel are connected near the center electrodes of the plasma display panel. The means for connecting the first current path and the second current path is a conductor, a semiconductor device or a device to be conducted in a high frequency region such as a capacitor.

(4) A pair of current paths in the folded U-shape are disposed so closely that electromagnetic induction occurs. As a method of closely disposing the pair of current paths, a slit-like cutout is formed on a conductor so that the current paths are disposed in parallel, adjacent layers of a multilayer substrate are used, or different types of substrates are attached to each other.

(5) A common electrode portion in which a plurality of X electrodes disposed on the plasma display panel are connected at an end face of the plasma display panel is used in place of the connection portion in the folded U-shape at the plasma display panel side.

(6) The connecting means and the plurality of X electrodes and Y electrodes are connected via a semiconductor device, respectively.

The effects obtained by typical aspects of the present invention will be briefly described below.

According to the present invention, it is possible to provide a plasma display device capable of increasing the luminance in the center part of a screen, by suppressing an inductance deviation to reduce a luminance difference in the entire screen below a permissible value.

BRIEF DESCRIPTIONS OF THE DRAWINGS

FIG. 18A is a diagram showing a parasitic inductance distribution when flexible substrates are discretely connected in the conventional plasma display device studied as a premise of the present invention; and FIG. 18B is a diagram showing a luminance distribution when flexible substrates are discretely connected in the conventional plasma display device studied as a premise of the present invention.

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted.

Figure 1:
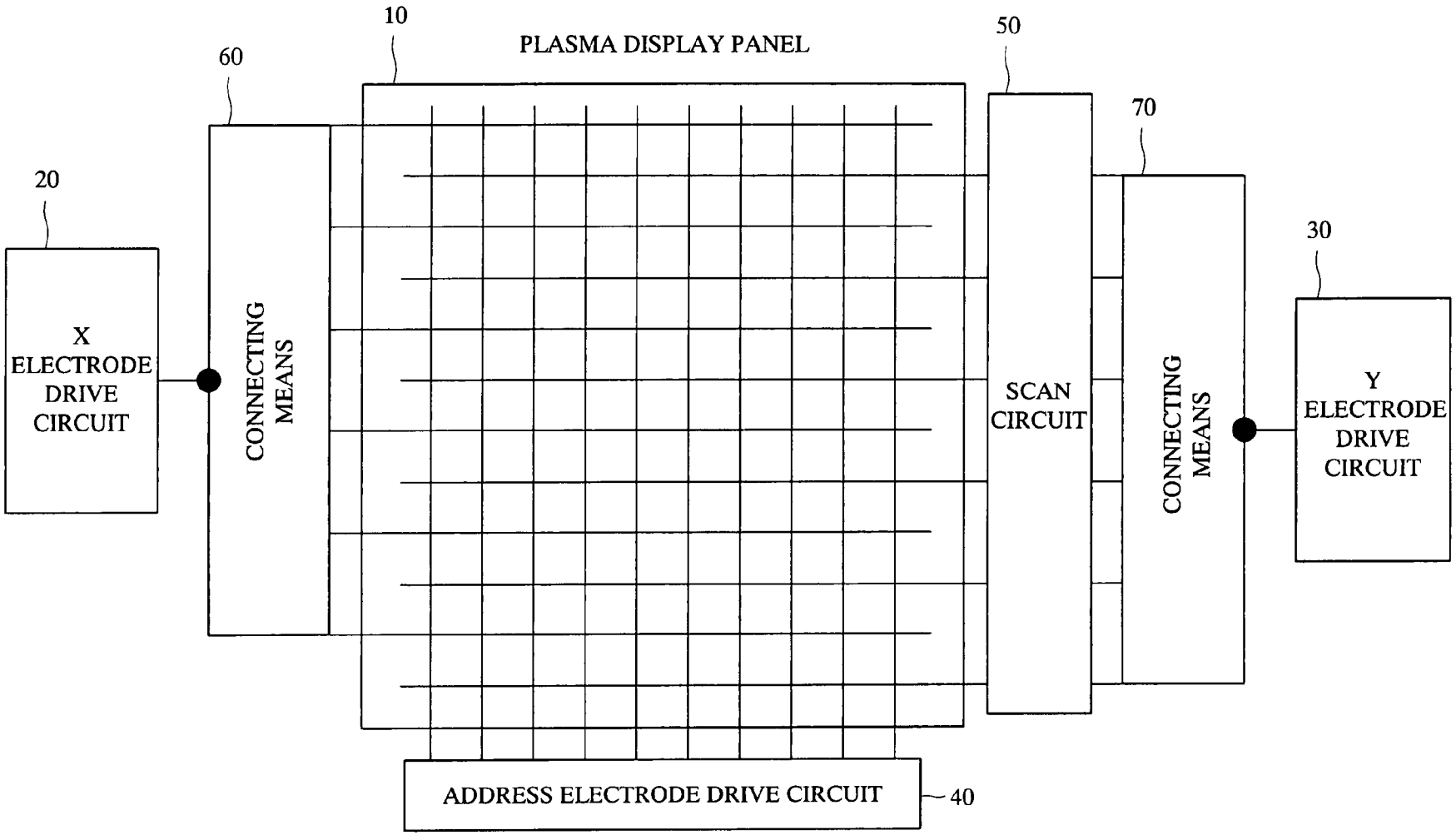
FIG. 1 is a diagram showing a schematic structure of a plasma display device according to one embodiment of the present invention.

First, an example of a structure of a plasma display device according to one embodiment of the present invention will be described with reference to FIG. 1. FIG. 1 shows a schematic structure of the plasma display device.

The plasma display device according to the present embodiment includes a plasma display panel 10, an X electrode drive circuit 20 for driving a plurality of X electrodes of the plasma display panel 10, a Y electrode drive circuit 30 for driving a plurality of Y electrodes of the plasma display panel 10, an address electrode drive circuit 40 for driving a plurality of address electrodes of the plasma display panel 10, a scan circuit 50 for scanning a plurality of Y electrodes of the plasma display panel 10, and others. In such a structure, each X electrode in the plasma display panel 10 and the X electrode drive circuit 20, and each Y electrode in the plasma display panel 10 and the Y electrode drive circuit 30 are electrically connected though connecting means 60 and 70 such as a printed board and flexible substrate, respectively.

In the plasma display device formed as described above, X electrodes and Y electrodes which are disposed in parallel are formed and address electrodes are formed orthogonally thereto in the plasma display panel 10. The X electrodes and the Y electrodes mainly perform sustain discharge for the display light emission. A voltage pulse is repeatedly applied between the X electrodes and the Y electrodes to perform the sustain discharges. Further, the Y electrode functions also as a scan electrode when writing display data. On the other hand, the address electrode is used to select a discharge cell to emit light, and a voltage for performing write discharge for selecting a discharge cell is applied between the Y electrodes and the address electrodes.

Since the discharge of the plasma display panel 10 uses only a binary state of ON and OFF, brightness contrast, that is, grayscale is expressed by the number of times of light emission. Thus, a frame is divided into a plurality of subfields. Each subfield is composed of a reset period, an address period, a sustain discharge period (sustain period) and the like. In the reset period, all the discharge cells are set into an initial state, for example, into a state where wall charges are erased irrespective of a light state in a pervious subfield. In the address period, selective discharge (address discharge) is performed for determining ON or OFF state of the discharge cells in accordance with the display data, and wall charges for setting the discharge cells into the ON state are selectively formed. In the sustain discharge period, discharge is repeated in the discharge cells in which wall charges are formed by the address discharge to emit a predetermined light. Such driving is controlled by the X electrode drive circuit 20, the Y electrode drive circuit 30, the address electrode drive circuit 40, and the scan circuit 50.

Figure 2:
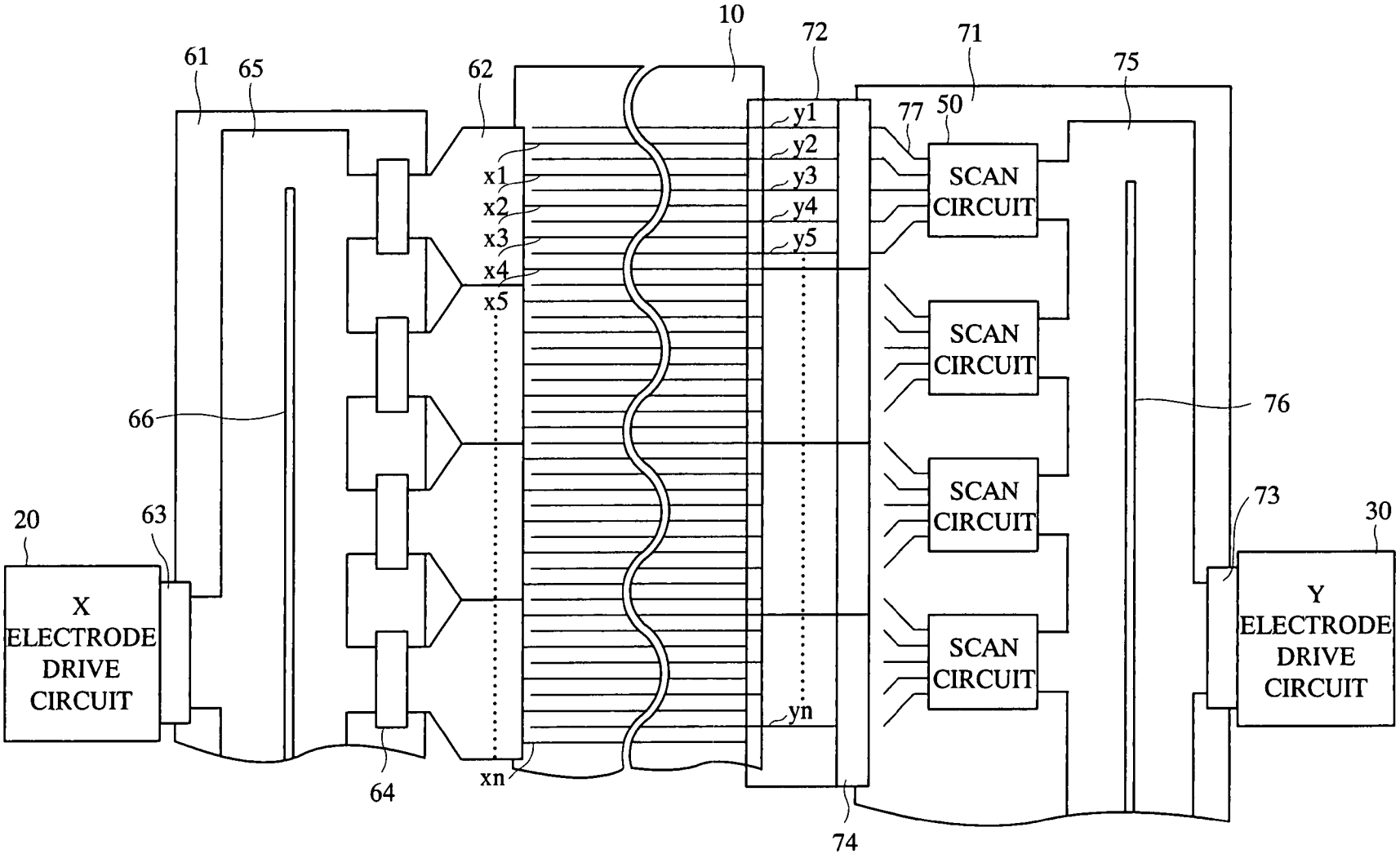
FIG. 2 is a diagram showing a connection form between a plasma display panel and X and Y electrode drive circuits in the plasma display device according to one embodiment of the present invention.

Next, an example of a connection form between the plasma display panel and the X and Y electrode drive circuits will be described with reference to FIG. 2. FIG. 2 shows a connection form between the plasma display panel and the X and Y electrode drive circuits.

The X electrodes (x1 to xn) of the plasma display panel 10 are connected to the X electrode drive circuit 20 through a printed board 61 and a flexible substrate 62. The X electrode drive circuit 20 and the printed board 61, and the printed board 61 and the flexible substrate 62 are connected via connectors 63 and 64, respectively, and a conductor of the flexible substrate 62 is connected to each X electrode of the plasma display panel 10 by thermocompression or the like. Also, an X electrode pattern 65 for connecting the connector 63 and the connectors 64 is formed on the printed board 61.

In particular, the X electrode pattern 65 has a structure in which a current path connecting the center electrodes of the plasma display panel 10 and the X electrode drive circuit 20 is longer than a current path connecting peripheral electrodes and the X electrode drive circuit 20. More specifically, the current path of this X electrode pattern 65 is formed in a U-shape folded in the upper part (or lower part: shown in FIG. 3) in the periphery of the plasma display panel 10, and is first connected to the electrodes of the upper part (or those of lower part) and then is sequentially connected to the center electrodes via the upper part (or lower part). Thus, in the X electrode pattern 65, a slit-like cutout 66 is formed on a conductor of the X electrode pattern 65 so that a pair of current paths in the folded U-shape are disposed in parallel and so closely that electromagnetic induction occurs. In other words, the slit-like cutout 66 is formed thin so that conductors at the right and left sides of the cutout 66 generate electromagnetic induction.

On the other hand, the Y electrodes (y1 to yn) of the plasma display panel 10 are connected to the Y electrode drive circuit 30 through a printed board 71 and a flexible substrate 72 in the same manner as the X electrodes of the plasma display panel 10 and the X electrode drive circuit 20. The Y electrode drive circuit 30 and the printed board 71, and the printed board 71 and the flexible substrate 72 are connected via connectors 73 and 74, respectively, and a conductor of the flexible substrate 72 and each Y electrode of the plasma display panel 10 are connected by thermocompression or the like. Different from the printed board 61 at the X electrode side, the printed board 71 is mounted with the scan circuits 50. Also, a Y electrode pattern 75 for connecting the connector 73 and the scan circuits 50 is formed and wiring patterns 77 for connecting the scan circuits 50 and the connectors 74 are further formed on the printed board 71.

Particularly, similar to the X electrode pattern 65, the Y electrode pattern 75 also has a structure in which a current path connecting center electrodes of the plasma display panel 10 and the Y electrode drive circuit 30 is longer than a current path connecting peripheral electrodes and the Y electrode drive circuit 30. More specifically, the current path of this Y electrode pattern 75 is formed in a U-shape folded in the upper part (or lower part) in the periphery of the plasma display panel 10, and is first connected to the electrodes of the upper part (or those of lower part) and then is sequentially connected to the center electrodes via the upper part (or lower part). Thus, in the Y electrode pattern 75, a slit-like cutout 76 is formed on a conductor of the Y electrode pattern 75, and the slit-like cutout 76 is formed thin so that conductors at the right and left sides of the cutout 76 generate electromagnetic induction.

Figure 3:
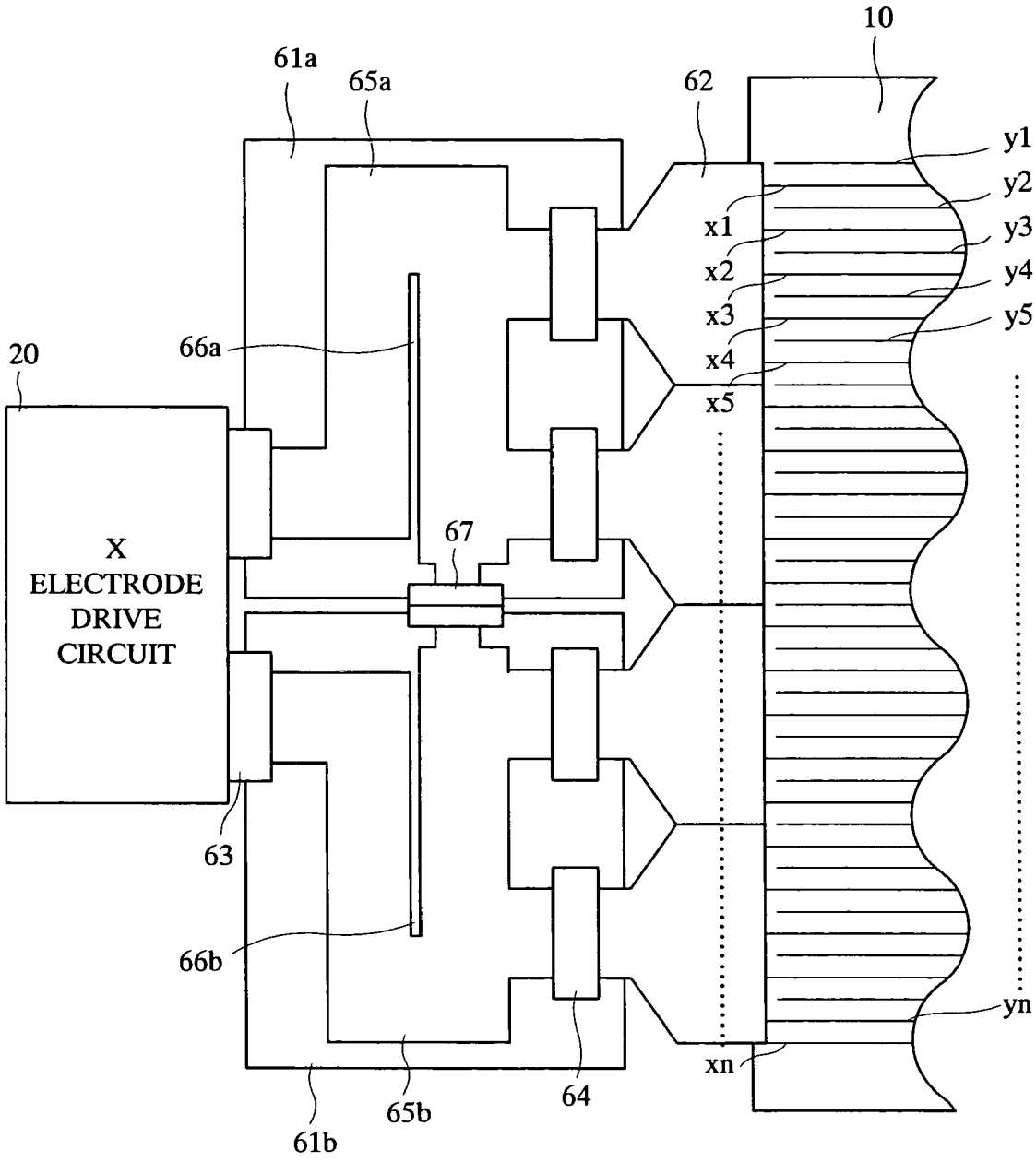
FIG. 3 is a diagram showing a connection form in which a current path extending through the upper part of the plasma display panel and a current path extending through the lower part thereof are connected near center electrodes in the plasma display device according to one embodiment of the present invention.

Next, one example of the connection form between the plasma display panel and the X electrode drive circuit will be described with reference to FIG. 3, in which a current path extending through the upper part of the plasma display panel and a current path extending through the lower part thereof are connected near the center electrodes of the plasma display panel. FIG. 3 shows a connection form in which the current path extending through the upper part of the plasma display panel and the current path extending through the lower part thereof are connected near the center electrodes.

The printed board 61 is separated into an upper printed board 61*a* and a lower printed board 61*b*. An X electrode pattern 65*a* serving as a first current path extending through the upper part of the plasma display panel 10 is formed on the upper printed board 61*a*, and an X electrode pattern 65*b* serving as a second current path extending through the lower part of the plasma display panel 10 is formed on the lower printed board 61*b*.

Similar to the case in FIG. 2 described above, slit-like cutouts 66*a* and 66*b* are formed in the X electrode pattern 65*a* formed on the upper printed board 61*a* and the X electrode pattern 65*b* formed on the lower printed board 61*a*, respectively. A conductor of the X electrode pattern 65*a* extending through the upper part of the plasma display panel 10 and a conductor of the X electrode pattern 65*b* extending through the lower part of the plasma display panel 10 are connected near the center electrodes of the plasma display panel 10 via a connector 67. A part for the connection can be applied to other conductor, a semiconductor device, or a device to be conducted in a high frequency region such as a capacitor other than the connector 67.

For example, when the screen size of the plasma display panel 10 is enlarged, one printed board 61 is not enough to form the screen in some cases, and the printed board 61 has to be divided into the upper and lower parts. In this case, as means for connecting the center parts, a conductor such as a connector or a metal fitting is simply used for the connection in some cases. Also, when the X electrode drive circuit 20 and the Y electrode drive circuit 30 are divided into the upper and lower parts and operate separately in the period other than the sustain period as described later, the connection therebetween is required in the sustain period, and a semiconductor device or a capacitor to be conducted in a high frequency region is used in such a case.

Though not shown, also in the connection form between the plasma display panel 10 and the Y electrode drive circuit 30, a conductor of the Y electrode pattern serving as a first current path extending through the upper part of the plasma display panel 10 and a conductor of the Y electrode pattern serving as a second current path extending through the lower part of the plasma display panel 10 are connected near the center electrodes of the plasma display panel 10 via a connector.

Figure 4:
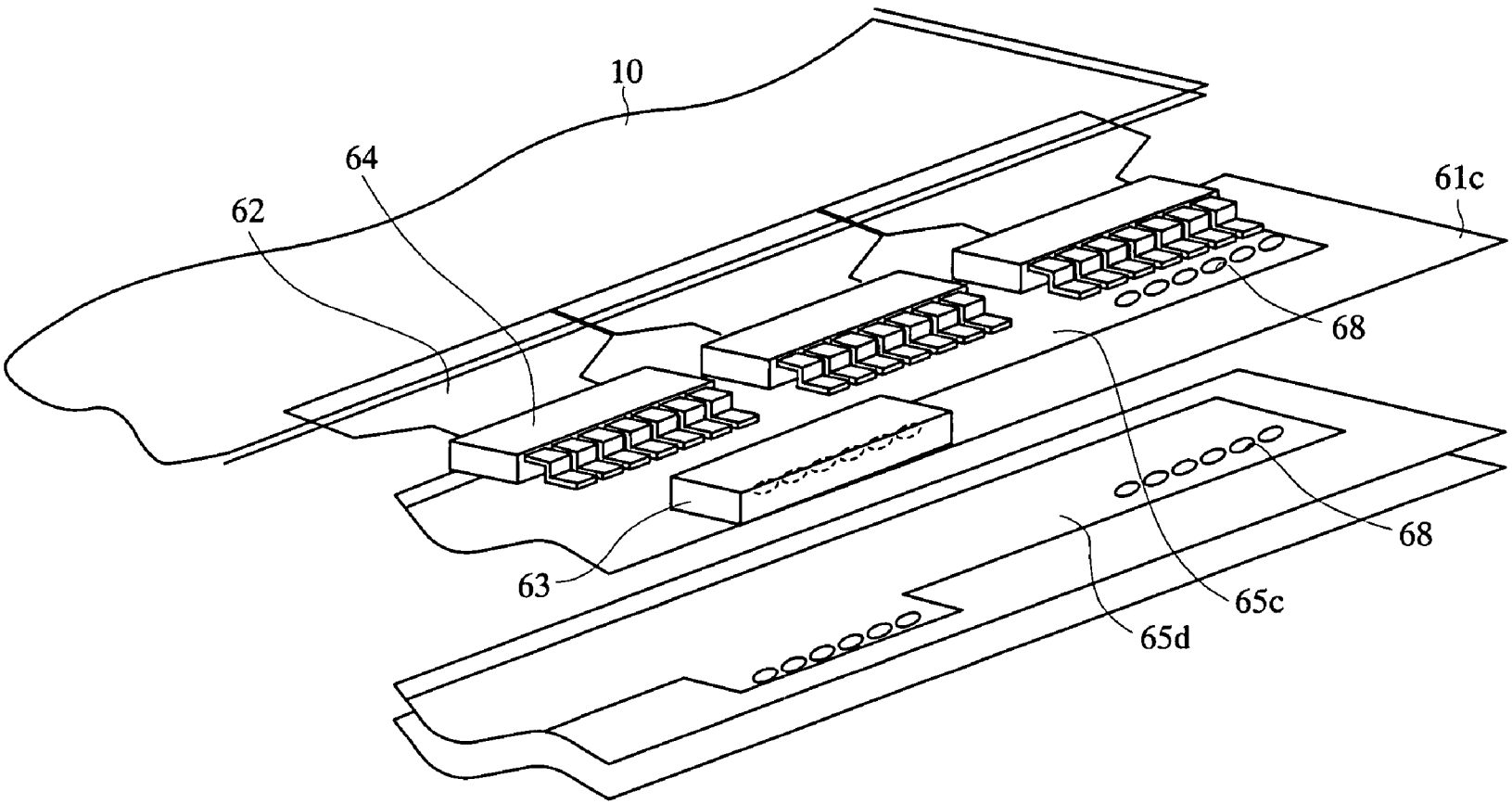
FIG. 4 is a diagram showing a connection form in which adjacent layers of a multilayer substrate are used to closely dispose a pair of current paths in the plasma display device according to one embodiment of the present invention.
Figure 5:
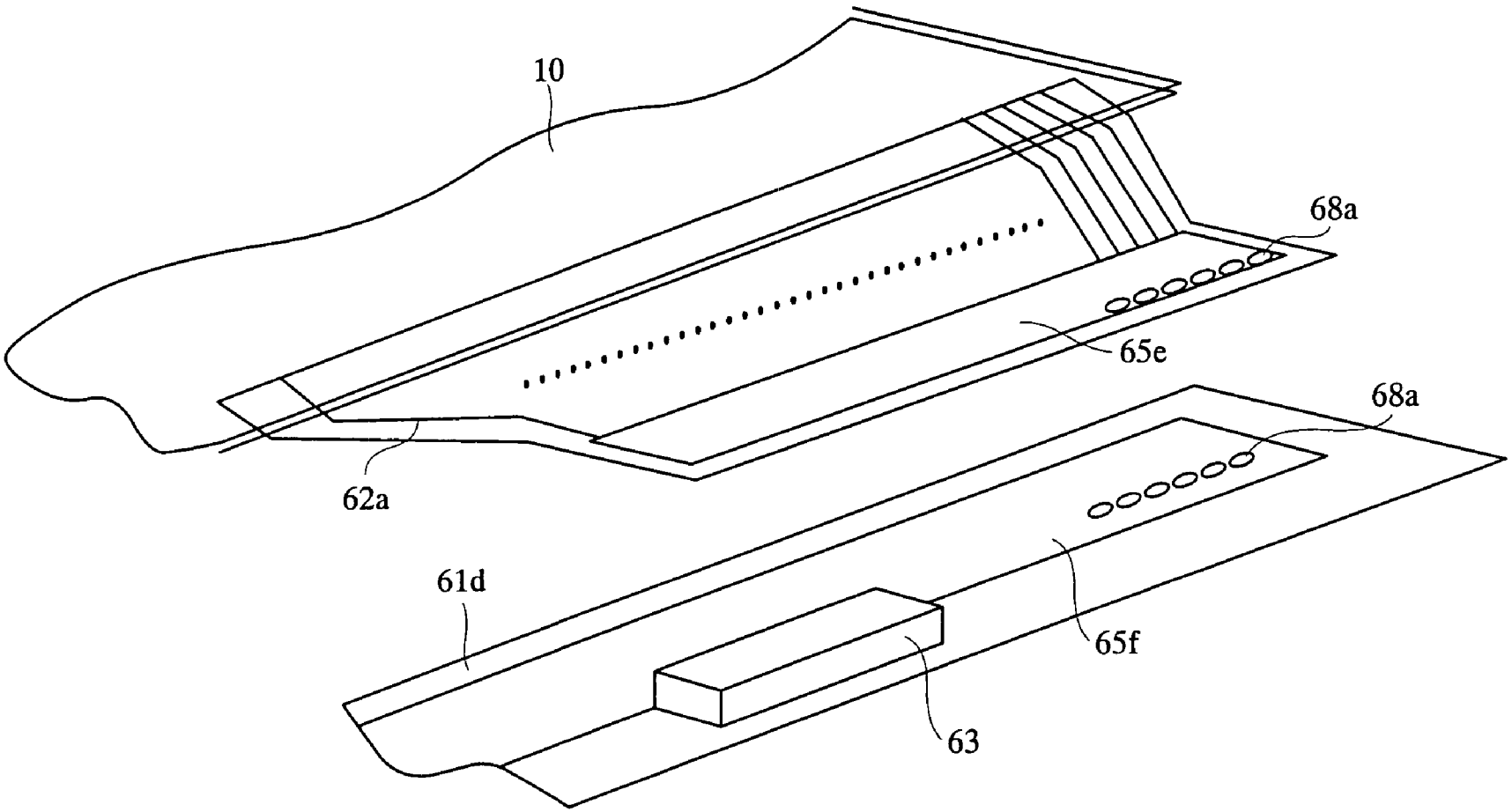
FIG. 5 is a diagram showing a connection form in which different types of substrates are attached to each other to closely dispose a pair of current paths in the plasma display device according to one embodiment of the present invention.

Next, another example of the connection form between the plasma display panel and the X electrode drive circuit will be described with reference to FIG. 4 and FIG. 5, in which a pair of current paths in the folded U-shape are closely disposed. FIG. 4 shows a connection form in which adjacent layers of a multilayer substrate are used to closely dispose a pair of current paths. FIG. 5 shows a connection form in which different types of substrates are attached together so as to closely dispose a pair of current paths.

In FIG. 4, a printed board 61*c* is made of a multilayer substrate having several layers. In this printed board 61*c*, one X electrode pattern 65*c*, which forms a pair of current paths together with the connector 63 for the X electrode drive circuit 20 and the connectors 64 for the flexible substrate 62, is formed on an insulator of the first layer and the other X electrode pattern 65*d* is formed on an insulator of the second layer. The X electrode patterns 65*c* and 65*d* of the first layer and second layer are partially connected via through holes 68. Thus, a structure in which a pair of current paths in the folded U-shape are closely disposed is formed in the adjacent layers of the first and second layers in the printed board 61*c*.

FIG. 5 shows a structure composed of different types of substrates, in which a flexible substrate 62*a* and a printed board 61*d* are attached to each other. In this structure, one X electrode pattern 65*e* which forms a pair of current paths is formed on the flexible substrate 62*a* connected to the X electrodes of the plasma display panel 10, and the other X electrode pattern 65*f* is formed on an insulator of the printed board 61*d* on which the connector 63 for the X electrode drive circuit 20 is mounted. Also, the X electrode patterns 65*e* and 65*f* of the flexible substrate 62*a* and the printed board 61*d* are partially connected through a conductive material such as solder filled in conductive lands 68*a*. Thus, in the structure in which different types of substrates such as the flexible substrate 62*a* and the printed board 61*d* are attached to each other, a pair of current paths in the folded U-shape are closely disposed.

Though not shown, also in the connection form between the plasma display panel 10 and the Y electrode drive circuit 30, a pair of current paths in the folded U-shape are closely disposed in the adjacent layers of the first and second layers of the printed board or in the structure in which different types of substrates such as the flexible substrate and printed board are attached to each other.

Figure 6:
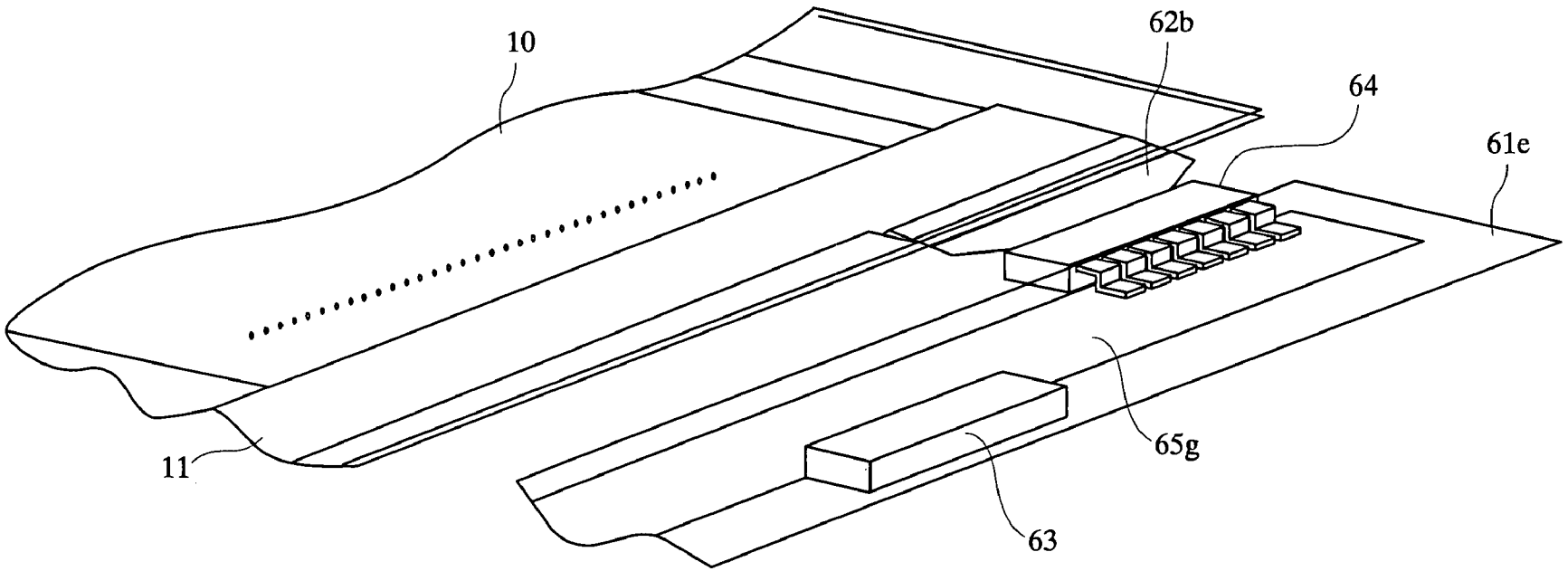
FIG. 6 is a diagram showing a connection form in which a common electrode portion connected at an end face of the plasma display panel is used in place of a connection portion in a folded U-shape at the plasma display panel side in the plasma display device according to one embodiment of the present invention.

Next, another example of the connection form between the plasma display panel and the X electrode drive circuit will be described with reference to FIG. 6, in which a common electrode portion connected at an end face of the plasma display panel is used in place of the connection portion in the folded U-shape at the plasma display panel side. FIG. 6 shows a connection form in which a common electrode portion connected at an end face of the plasma display panel is used in place of the connection portion in the folded U-shape at the plasma display panel side.

The plasma display panel 10 is provided with a common electrode portion 11 in which a plurality of X electrodes are connected at an end face of the plasma display panel 10, and the common electrode portion 11 is used in place of the connection portion in the folded U-shape at the plasma display panel 10 side. Thus, the common electrode portion 11 on the plasma display panel 10 and an X electrode pattern 65*g* on the printed board 61*e* can be connected by the flexible substrate 62*b* and a pair of current paths in the folded U-shape can be formed without forming a slit-like cutout in the printed board 61*e*. Also in this case, it is desirable that the pair of current paths are closely disposed.

Figure 7:
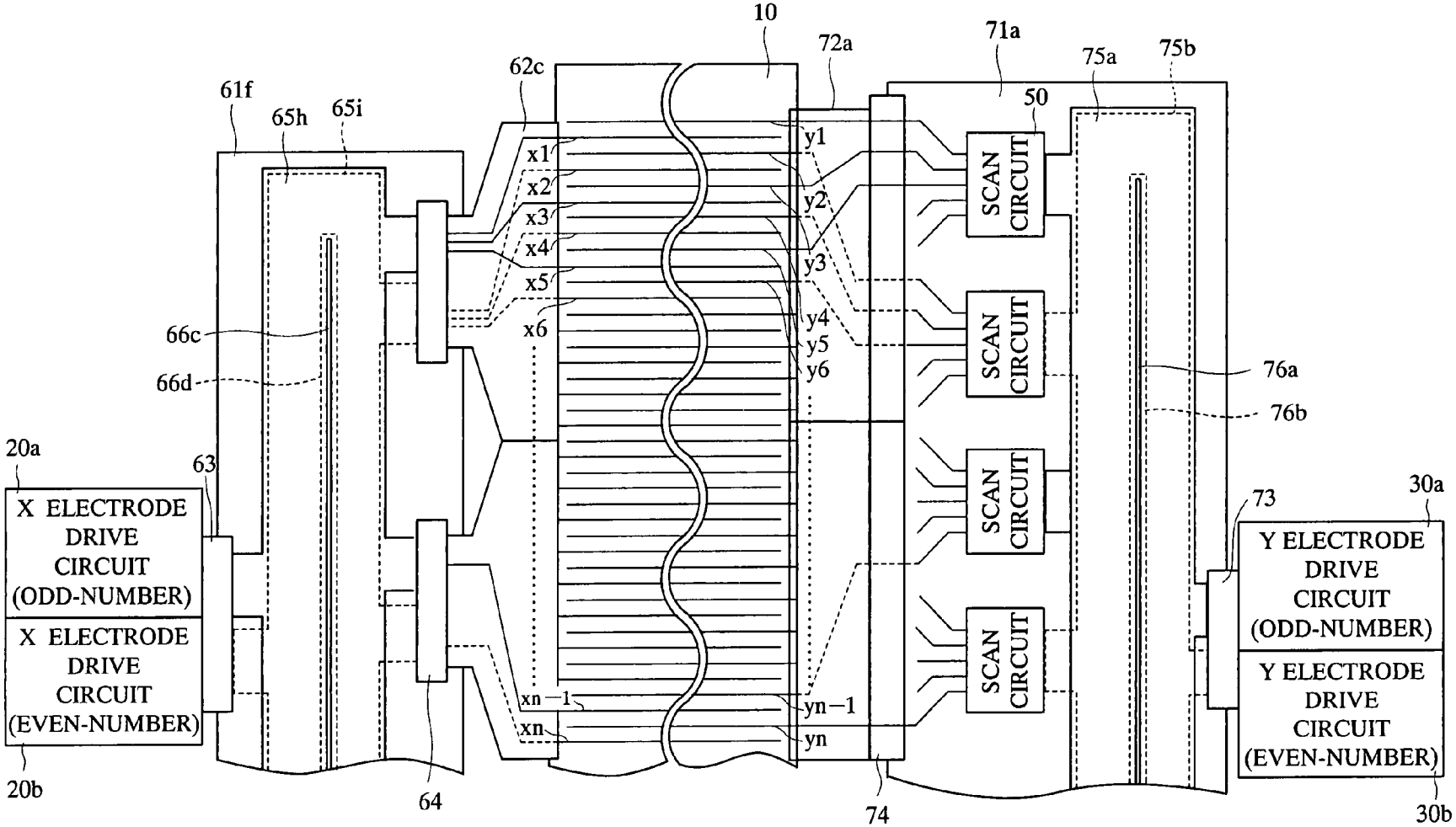
FIG. 7 is a diagram showing a connection form between a plasma display panel having an odd/even separation structure and the X and Y electrode drive circuits in the plasma display device according to one embodiment of the present invention.

Next, one example in which the X electrode drive circuit for driving the X electrodes and the Y electrode drive circuit for driving the Y electrodes of the plasma display panel are separated into several parts will be described with reference to FIG. 7. FIG. 7 shows a connection form between the plasma display panel and the X and Y electrode drive circuits in an odd/even separation structure as one example of the separation.

In the structure in which a plurality of X electrodes and Y electrodes of the plasma display panel 10 are separated into odd-numbered electrodes (x1, x3, . . . , xn−1 and y1, y3, . . . , yn−1) and even-numbered electrodes (x2, x4, . . . , xn, and y2, y4, . . . , yn), two X electrode drive circuits 20*a* and 20*b* and two Y electrode drive circuits 30*a* and 30*b* are provided for the odd-numbered electrodes and the even-numbered electrodes. Further, also in the printed boards 61*f* and 71*a*, the X electrode pattern 65 and the Y electrode pattern 75 are separated into those for the odd-numbered electrodes and the even-numbered electrodes and are formed in different layers. For example, in FIG. 7, an X electrode pattern 65*h* and a Y electrode pattern 75*a* for the odd-numbered electrodes are formed on the front surface (shown by solid lines) and an X electrode pattern 65*i* and a Y electrode pattern 75*b* for the even-numbered electrodes are formed on the rear surface (shown by dashed lines).

Similarly, also in the flexible substrates 62*c* and 72*a*, wiring patterns for the odd-numbered electrodes are formed on the front surface (shown by solid lines) and wiring patterns for the even-numbered electrodes are formed on the rear surface (shown by dashed lines).

Also in this structure, similar to FIG. 2, the current paths by the X electrode patterns 65*h* and 65*i* and the current paths by the Y electrode pattern 75*a* and 75*b* are formed in the U-shape folded in the periphery of the plasma display panel 10. Therefore, the X electrode patterns 65*h* and 65*i* and the Y electrode patterns 75*a* and 75*b* have slit-like cutouts 66*c*, 66*d*, 76*a* and 76*b* formed on the conductors of each electrode pattern, and conductors at the right and left sides of the cutouts 66*c*, 66*d*, 76*a*, and 76*b* are formed so closely that electromagnetic induction occurs.

Figure 8:
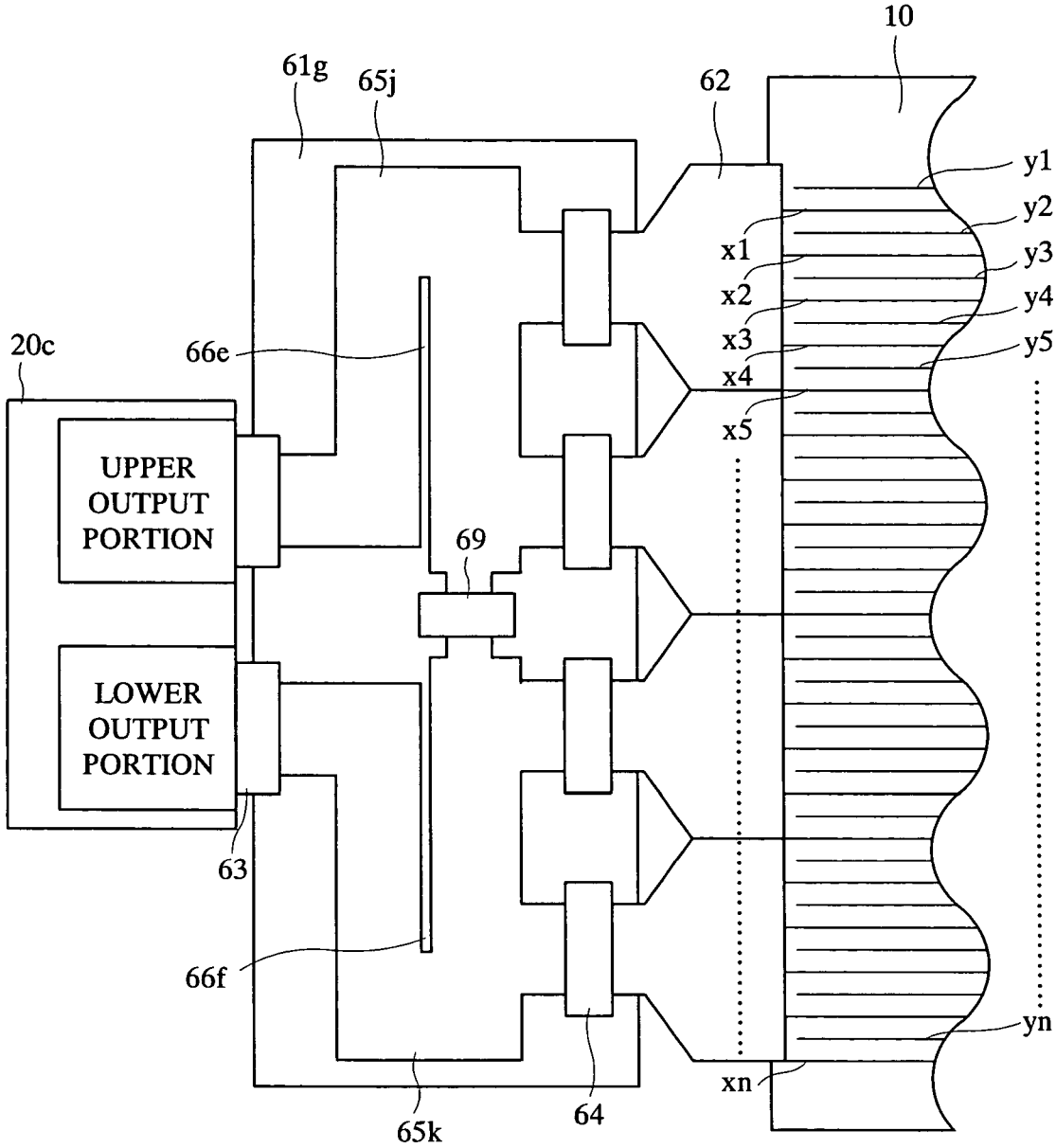
FIG. 8 is a diagram showing a connection form in which a current path extending through the upper part and a current path extending through the lower part are connected near center electrodes when an output portion of the X electrode drive circuit is separated into an upper part and a lower part in the plasma display device according to one embodiment of the present invention.

Next, another example of the connection form between the plasma display panel and the X electrode drive circuit will be described with reference to FIG. 8, in which an output portion of the X electrode drive circuit is separated into the upper part and the lower part and a current path extending through the upper part of the plasma display panel and a current path extending through the lower part thereof are connected near the center electrodes. FIG. 8 shows a connection form in which the output portion of the X electrode drive circuit is separated into an upper part and a lower part and the current path extending through the upper part and the current path extending through the lower part are connected near the center electrodes.

In the structure in which the output portion of the X electrode drive circuit 20*c* is separated into the upper part and the lower part, the X electrode pattern 65 of the printed board 61*g* is formed to be separated into the upper part and the lower part. Also in this structure, an upper X electrode pattern 65*j* and a lower X electrode pattern 65*k* have slit-like cutouts 66*e* and 66*f* formed on a conductor of each electrode pattern, and the conductors at the right and left sides of the cutouts 66*e* and 66*f* are formed so closely that electromagnetic induction occurs. Further, the conductor of the upper X electrode pattern 65*j* and the conductor of the lower X electrode pattern 65*k* are connected near the center electrodes of the plasma display panel 10 via a semiconductor device 69.

Though not shown, also in a connection form between the plasma display panel 10 and the Y electrode drive circuit 30, a conductor of an upper Y electrode pattern and a conductor of a lower Y electrode pattern are connected near the center electrodes of the plasma display panel 10 via a semiconductor device.

Figure 9A:
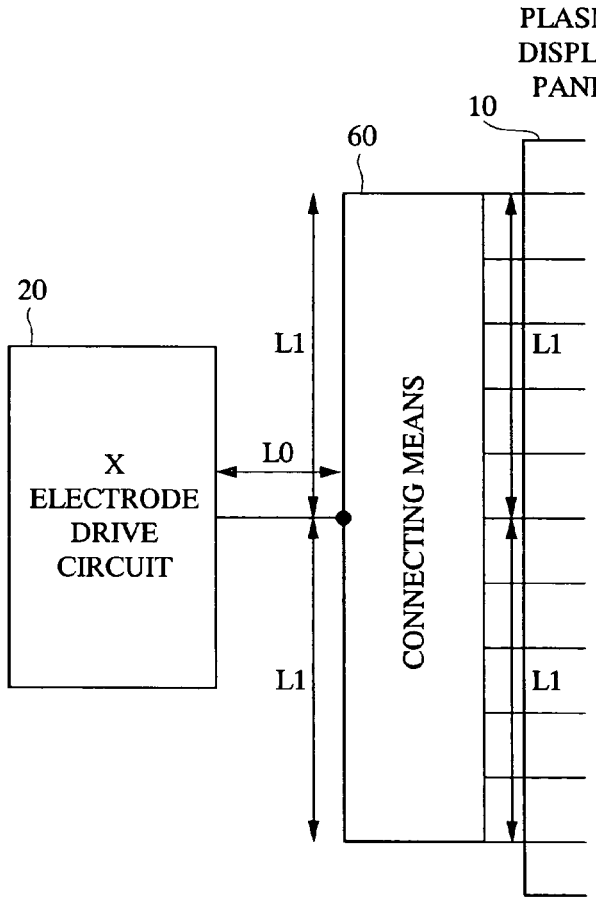
FIG. 9A is a diagram showing a parasitic inductance distribution when a current path in an X electrode pattern and a current path in a Y electrode pattern are formed into a U-shape folded in the periphery of the plasma display panel in the plasma display device according to one embodiment of the present invention.
Figure 9B:
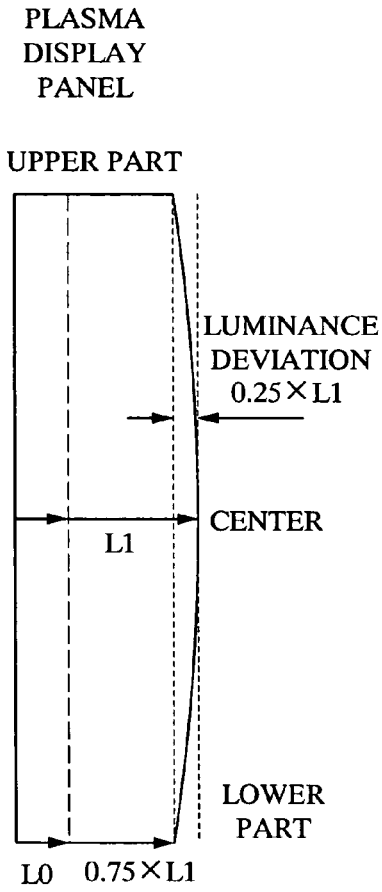
FIG. 9B is a diagram showing a luminance distribution when a current path in an X electrode pattern and a current path in a Y electrode pattern are formed into a U-shape folded in the periphery of the plasma display panel in the plasma display device according to one embodiment of the present invention.
Figure 10A:
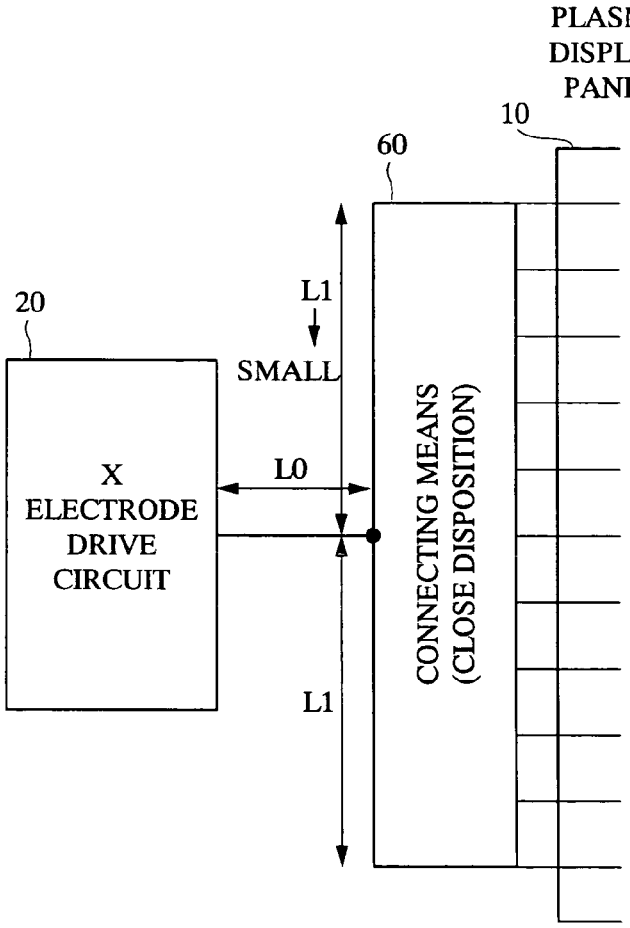
FIG. 10A is a diagram showing a parasitic inductance distribution when a pair of current paths in a folded U-shape are disposed in parallel and so closely that electromagnetic induction occurs in the plasma display device according to one embodiment of the present invention.
Figure 10B:
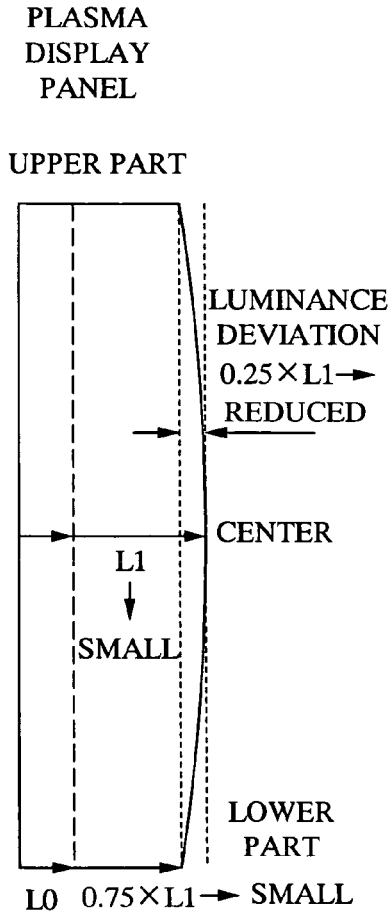
FIG. 10B is a diagram showing a luminance distribution when a pair of current paths in a folded U-shape are disposed in parallel and so closely that electromagnetic induction occurs in the plasma display device according to one embodiment of the present invention.
Figures 11A, 11B:
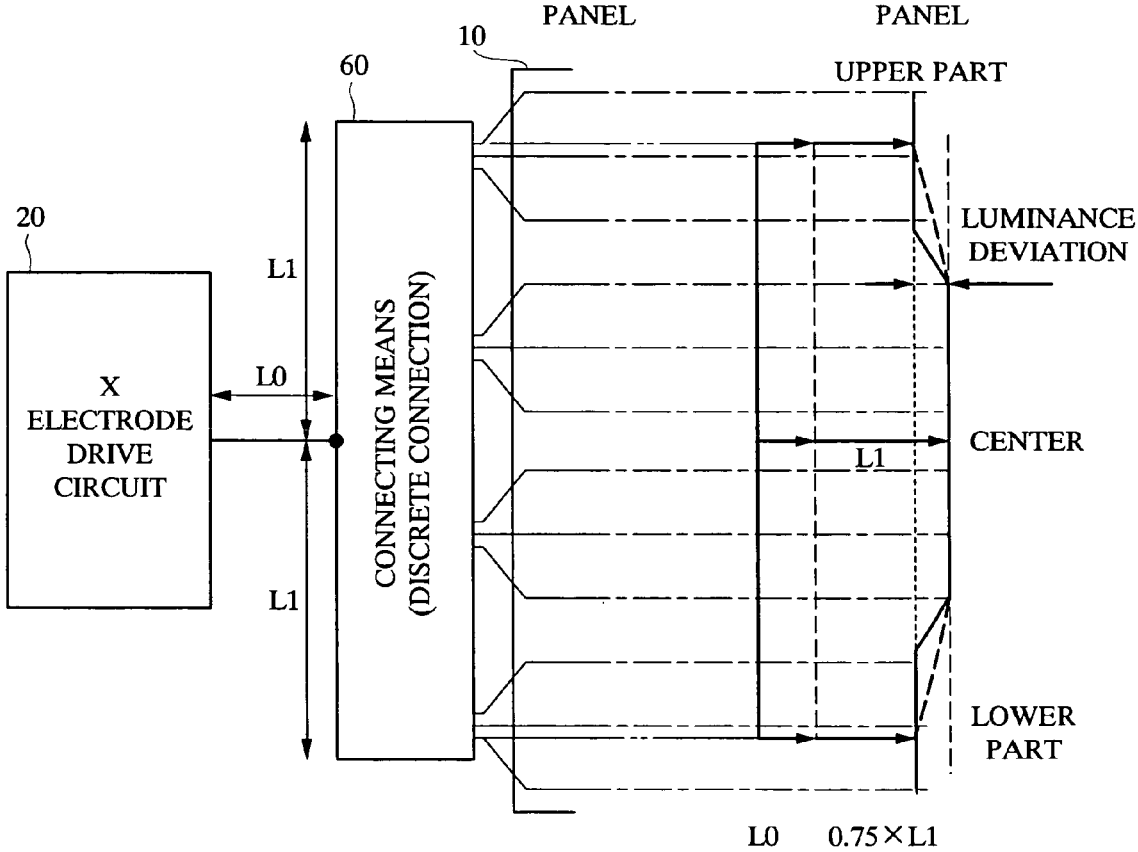
FIG. 11A is a diagram showing a parasitic inductance distribution when flexible substrates are discretely connected in the plasma display device according to one embodiment of the present invention.
FIG. 11B is a diagram showing a luminance distribution when flexible substrates are discretely connected in the plasma display device according to one embodiment of the present invention.
Figure 12:
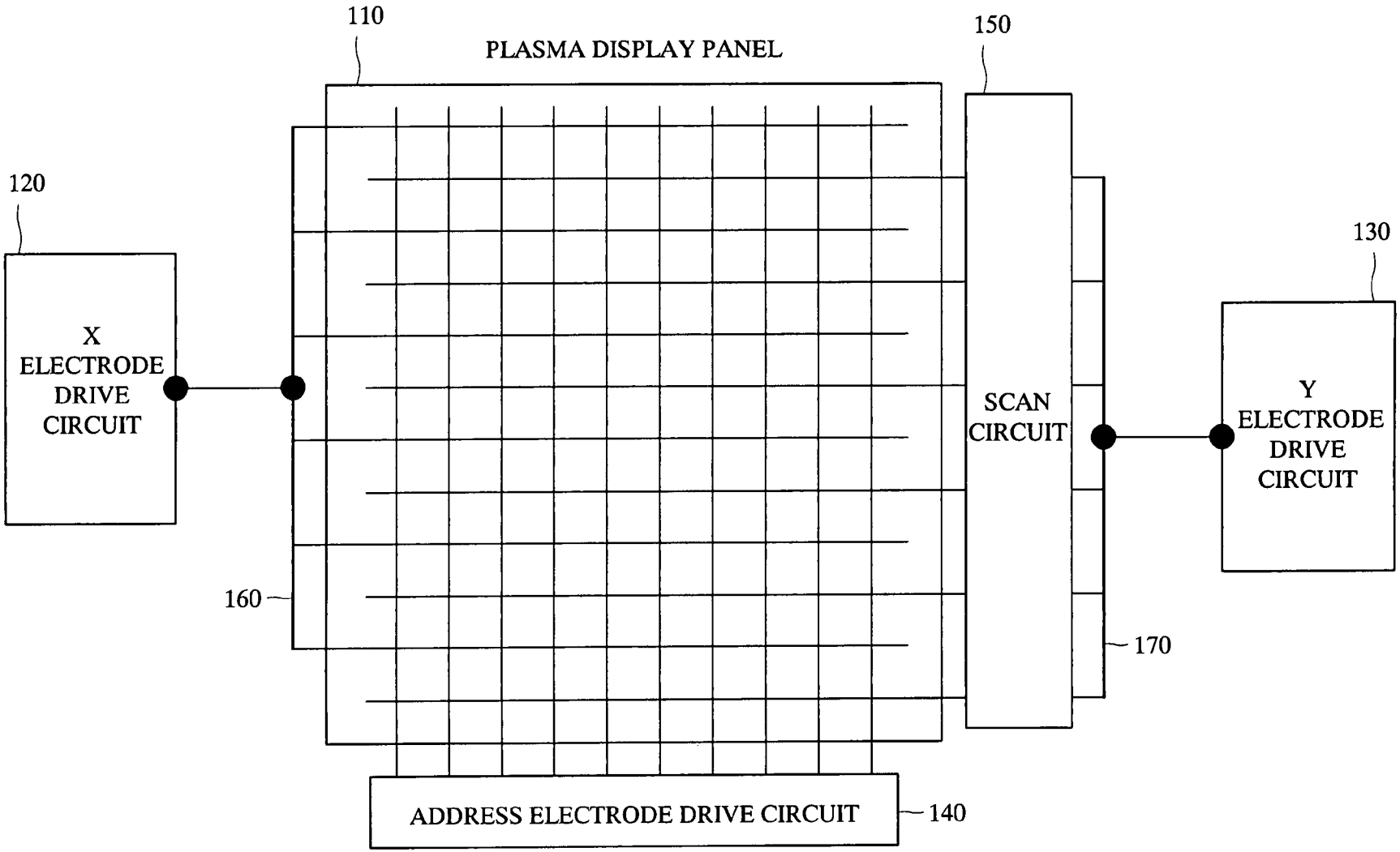
FIG. 12 is a diagram showing a schematic structure of a conventional plasma display device studied as a premise of the present invention.
Figure 13:
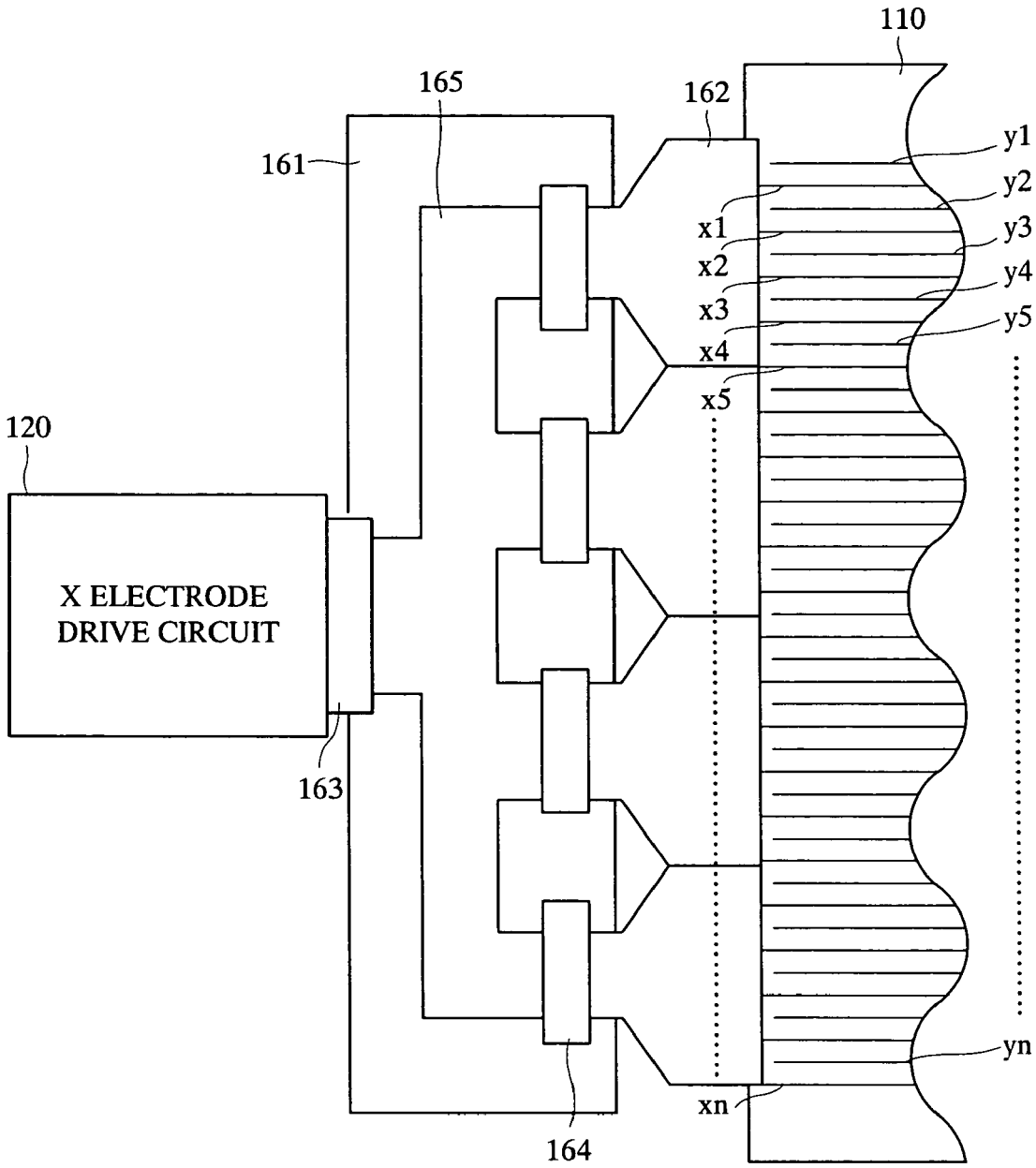
FIG. 13 is a diagram showing a connection form between a plasma display panel and an X electrode drive circuit in the conventional plasma display device studied as a premise of the present invention.
Figure 14:
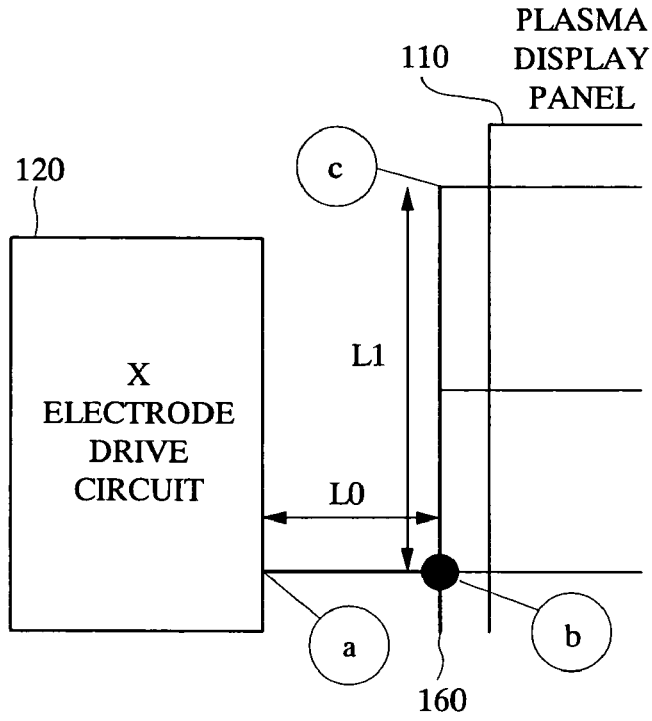
FIG. 14 is a diagram showing a parasitic inductance distribution in a connection portion between the plasma display panel and the X electrode drive circuit in the conventional plasma display device studied as a premise of the present invention.
Figure 15:
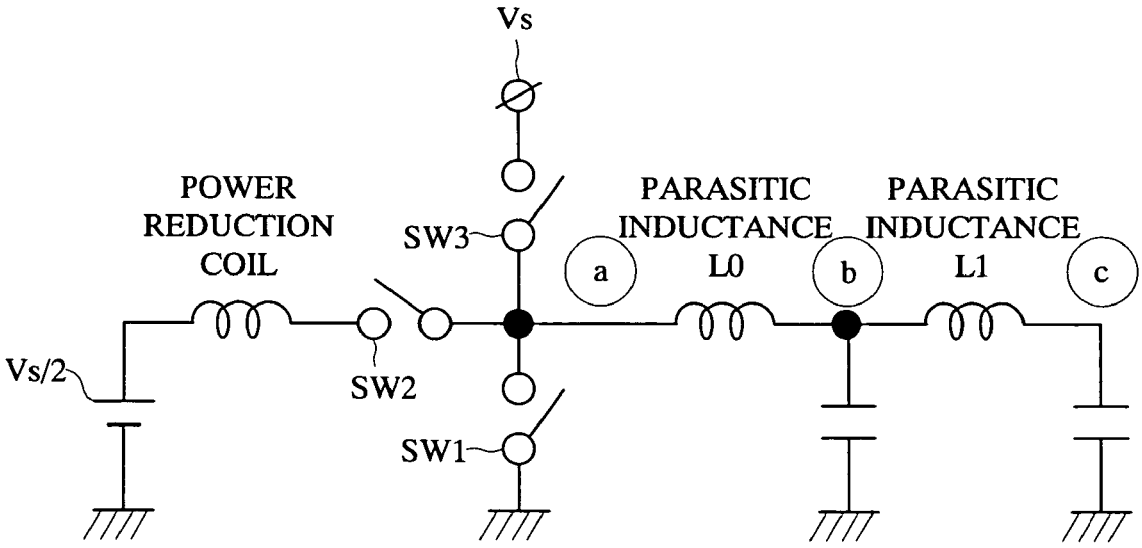
FIG. 15 is a diagram showing an equivalent circuit in the connection portion between the plasma display panel and the X electrode drive circuit in the conventional plasma display device studied as a premise of the present invention.
Figure 16:
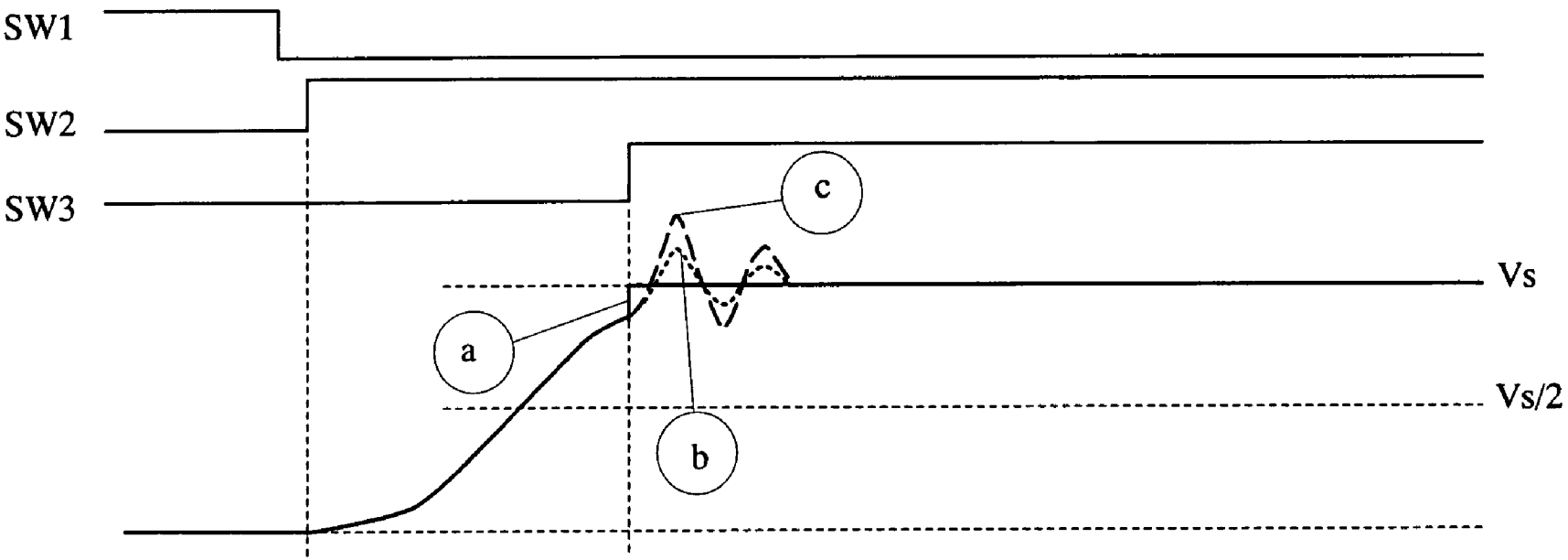
FIG. 16 is a diagram showing drive waveforms in the connection portion between the plasma display panel and the X electrode drive circuit in the conventional plasma display device studied as a premise of the present invention.

Effects shown in FIG. 9 to FIG. 11 can be obtained from the plasma display device according to the present embodiment described above. FIG. 9 shows a parasitic inductance distribution (FIG. 9A) and a luminance distribution (FIG. 9B) when the current path in the X electrode pattern (also the current path in the Y electrode pattern) has a U-shape folded in the periphery of the plasma display panel. FIG. 10 shows a parasitic inductance distribution (FIG. 10A) and a luminance distribution (FIG. 10B) when a pair of current paths in the folded U-shape are disposed in parallel and so closely that electromagnetic induction occurs. FIG. 11 shows a parasitic inductance distribution (FIG. 11A) and a luminance distribution (FIG. 11B) when flexible substrates are discretely connected.

Figure 17A:
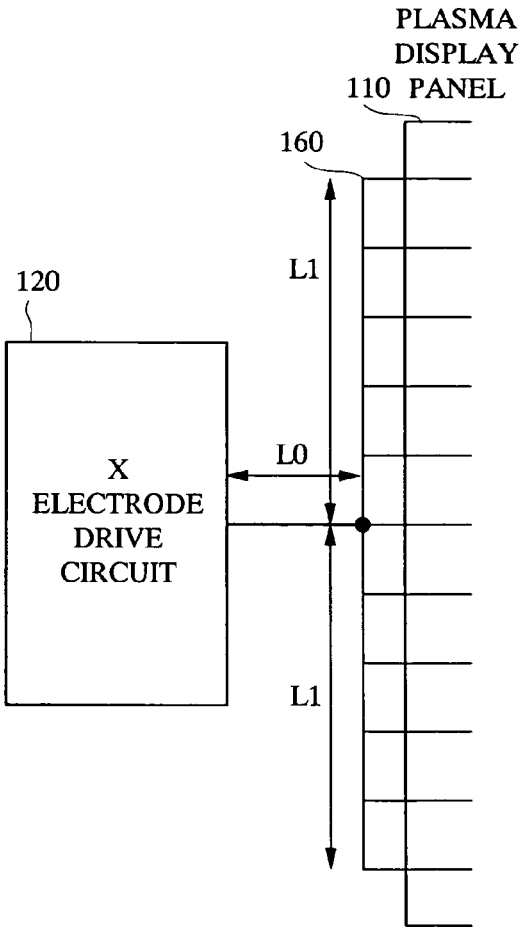
FIG. 17A is a diagram showing a parasitic inductance distribution in the connection portion between the plasma display panel and the X electrode drive circuit in the conventional plasma display device studied as a premise of the present invention.
Figure 17B:
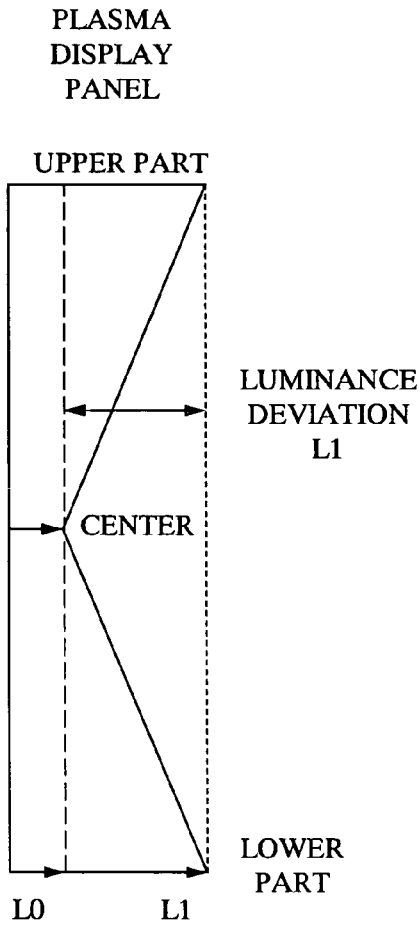
FIG. 17B is a diagram showing a luminance distribution in the connection portion between the plasma display panel and the X electrode drive circuit in the conventional plasma display device studied as a premise of the present invention.

As shown in FIG. 9, when the current path in the X electrode pattern (also the current path in the Y electrode pattern) is formed in the U-shape folded in the periphery of the plasma display panel 10, in the luminance distribution determined by the parasitic inductance distribution, the center of the plasma display panel 10 has the luminance corresponding to L0+L1 and the upper and lower parts of the plasma display panel 10 have the luminance corresponding to L0+0.75×L1. Accordingly, a luminance difference between the center and the upper and lower parts can be suppressed to that corresponding to a deviation by 0.25×L1. When comparing this luminance distribution with that of a conventional structure in FIG. 17, a luminance at the center of the plasma display panel 10 is increased from L0 to L0+L1 and a luminance in the upper and lower parts of the plasma display panel 10 is decreased from L0+L1 to L0+0.75×L1. As a result, a luminance deviation between the center and the upper and lower parts can be reduced from L1 to 0.25×L1.

A basis of each value 0.75 and 0.25 is as follows. That is, with respect to the inductance from the X electrode drive circuit 20 and the Y electrode drive circuit 30, in the current paths extending from a brunch point between upper and lower paths to the center through the upper part and the lower part, respectively, the inductance of the upper path is twice the inductance L1 (L1×2) because the path goes to and from the upper part. Since the inductance is combined with the inductance of the lower path (L1×2), the inductance becomes L1 ((L1×2)×½=L1). Next, in the paths from the brunch point between upper and lower paths to the upper part, the inductance of the shortest path (L1) and an inductance through the lower part (L1×3) are combined, and the inductance becomes 0.75×L1 (L1×(3×L1)/(L1+(3×L1))=0.75×L1). Therefore, a deviation between the center and the upper and lower parts is defined as 0.25×L1 (L1−0.75×L1=0.25×L1).

As shown in FIG. 10, when a pair of current paths in the folded U-shape are disposed in parallel and so closely that electromagnetic induction occurs, in comparison with the case where they are in the simply folded U-shape, a luminance at the center of the plasma display panel 10 can be decreased from L0+L1 by reducing L1 and a luminance in the upper and lower parts of the plasma display panel 10 can be decreased from L0+0.75×L1 by reducing 0.75×L1. As a result, it is possible to reduce the luminance deviation between the center and the upper and lower parts to be smaller than 0.25×L1. This is because, since the inductance of the connecting means 60 (70) can be reduced by the close disposition of in-phase and bidirectional current in the current paths, the luminance deviation between the center and the upper and lower parts of the screen can be reduced.

As shown in FIG. 11, when the flexible substrates are discretely connected, in comparison with a conventional structure of FIG. 18, the luminance at the center of the plasma display panel 10 is increased from L0 to L0+L1 and the luminance at the upper and lower parts of the plasma display panel 10 is decreased from L0+L1 to L0+0.75×L1. As a result, it is possible to alleviate the luminance deviation between the center and the upper and lower parts (a dashed line in the luminance distribution is that of FIG. 9B).

Therefore, according to the plasma display device of the present embodiment, it is possible to achieve the increase in the luminance at the center of the screen, while suppressing an inductance deviation and reducing a luminance difference in the entire screen below a permissible value. In particular, the plasma display device is further preferable in the case where the flexible substrates for the X electrodes and the Y electrodes are separately provided along with enlargement of the screen size of the plasma display panel 10.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention relates to a technology for the plasma display device and is applied to a connection structure between the X/Y electrodes and the X/Y electrode drive circuits in the plasma display panel. In particular, it is effectively applied to the case where the flexible substrates for the X electrode and the Y electrodes are separately provided along with enlargement in the screen size of the plasma display panel.

What is claimed is:

1. A plasma display device comprising:

a plasma display panel;

an X electrode drive circuit for driving a plurality of X electrodes of said plasma display panel;

a Y electrode drive circuit for driving a plurality of Y electrodes of said plasma display panel; and an address electrode drive circuit for driving a plurality of address electrodes of said plasma display panel;

a first connecting means for connecting each X electrode of said plasma display panel and said X electrode drive circuit; and a second connecting means for connecting each Y electrode of said plasma display panel and said Y electrode drive circuit, respectively;

wherein current paths at the plasma display panel side of said at least one of said first connecting unit and second connecting unit are disposed in a U-shape, and folded in an upper part and a lower part in the periphery of said plasma display panel, respectively, and said current paths are connected to upper electrodes and lower electrodes of said plasma display panel, respectively, extend through an upper part and a lower part, and are sequentially connected to center electrodes of said plasma display panel, and at least one of said first connecting means and said second connecting means has a structure, in which:

a current path that connects X electrodes or Y electrodes of said plasma display panel that are centrally located and correspond to the connecting means, and a corresponding said X electrode drive circuit or said Y electrode drive circuit, is longer than a current path that connects X electrodes or Y electrodes of said plasma display panel that are peripherally located and correspond to the connecting means, and said corresponding said X electrode drive circuit or said Y electrode drive circuit.

2. The plasma display device according to claim 1, wherein a first current path extending through the upper part of said plasma display panel, and a second current path extending through the lower part of said plasma display panel, are connected near the center electrodes of said plasma display panel.

3. The plasma display device according to claim 1, wherein said at least one of said first connecting unit and second connecting unit and said corresponding at least one X electrode and/or at least one Y electrode are connected via a semiconductor device, respectively.

4. The plasma display device according to claim 1, wherein a pair of current paths in the folded U-shape are disposed so closely that electromagnetic induction occurs.

5. The plasma display device according to claim 1, wherein a common electrode portion, in which a plurality of X electrodes disposed on said plasma display panel are connected at an end face of said plasma display panel, is used instead of a connection portion in the folded U-shape at the plasma display panel side.

6. The plasma display device according to claim 2, wherein a pair of current paths in the folded U-shape are disposed so closely that electromagnetic induction occurs.

7. The plasma display device according to claim 2, wherein at least one of a conductor, a semiconductor device, a capacitor, and another device configured to be conducted in a high frequency region connects said first current path and said second current path.

8. The plasma display device according to claim 7, wherein said at least one of said first connecting unit and second connecting unit and said corresponding at least one X electrode and/or at least one Y electrode are connected via a semiconductor device, respectively.

9. The plasma display device according to claim 2, wherein said at least one of said first connecting unit and second connecting unit and said corresponding at least one X electrode and/or at least one Y electrode are connected via a semiconductor device, respectively.

10. The plasma display device according to claim 2, wherein a common electrode portion, in which a plurality of X electrodes disposed on said plasma display panel are connected at an end face of said plasma display panel, is used instead of a connection portion in the folded U-shape at the plasma display panel side.

11. The plasma display device according to claim 6, wherein a common electrode portion, in which a plurality of X electrodes disposed on said plasma display panel are connected at an end face of said plasma display panel, is used instead of a connection portion in the folded U-shape at the plasma display panel side.

12. The plasma display device according to claim 11, wherein said at least one of said first connecting unit and second connecting unit and said corresponding at least one X electrode and/or at least one Y electrode are connected via a semiconductor device, respectively.

13. The plasma display device according to claim 6, wherein, as a method of closely disposing said pair of current paths, a slit-like cutout is formed on a conductor so that the current paths are disposed in parallel.

14. The plasma display device according to claim 13, wherein said at least one of said first connecting unit and second connecting unit and said corresponding at least one X electrode and/or at least one Y electrode are connected via a semiconductor device, respectively.

15. The plasma display device according to claim 6, wherein, as a method of closely disposing said pair of current paths, adjacent layers of a multilayer substrate are used.

16. The plasma display device according to claim 15, wherein said at least one of said first connecting unit and second connecting unit and said corresponding at least one X electrode and/or at least one Y electrode are connected via a semiconductor device, respectively.

17. The plasma display device according to claim 6, wherein, as a method of closely disposing said pair of current paths, different types of substrates are attached to each other.

18. The plasma display device according to claim 17, wherein said at least one of said first connecting unit and second connecting unit and said corresponding at least one X electrode and/or at least one Y electrode are connected via a semiconductor device, respectively.

19. The plasma display device according to claim 6, wherein said at least one of said first connecting unit and second connecting unit and said corresponding at least one X electrode and/or at least one Y electrode are connected via a semiconductor device, respectively.

20. A plasma display device comprising:

a plasma display panel;

an X electrode drive circuit, configured to drive a plurality of X electrodes of said plasma display panel;

a Y electrode drive circuit, configured to drive a plurality of Y electrodes of said plasma display panel; and an address electrode drive circuit, configured to drive a plurality of address electrodes of said plasma display panel;

a first connecting unit configured to connect at least one X electrode of said plasma display panel and said X electrode drive circuit; and a second connecting unit configured to connect at least one Y electrode of said plasma display panel and said Y electrode drive circuit;

wherein current paths at the plasma display panel side of said at least one of said first connecting unit and second connecting unit are disposed in a U-shape, and folded in an upper part and a lower part in the periphery of said plasma display panel, respectively, said current paths are connected to upper electrodes and lower electrodes of said plasma display panel, respectively, extend through an upper part and a lower part, and are sequentially connected to center electrodes of said plasma display panel, and at least one of: (1) said first connecting unit has a structure in which (a) a current path configured to connect a center X electrode of said plasma display panel and said X electrode drive circuit is longer than (b) a current path configured to connect a peripheral X electrode of said plasma display panel and said X electrode drive circuit, and (2) said second connecting unit has a structure in which (a) a current path configured to connect a center Y electrode of said plasma display panel and said Y electrode drive circuit is longer than (b) a current path configured to connect a peripheral Y electrode of said plasma display panel and said Y electrode drive circuit.

* * * * *